United States Patent [19]

Holzangel

[11] Patent Number: 4,485,826

[45] Date of Patent: Dec. 4, 1984

[54] APPARATUS FOR MAKING FILLERS FOR ROD-SHAPED SMOKERS' PRODUCTS HAVING DENSE ENDS

[75] Inventor: Uwe Holzangel, Glinde, Fed. Rep. of Germany

[73] Assignee: Hauni-Werke Körber & Co. KG, Hamburg, Fed. Rep. of Germany

[21] Appl. No.: 144,028

[22] Filed: Apr. 28, 1980

[51] Int. Cl.[3] ..... A24C 5/14; A24C 5/18

[52] U.S. Cl. ..... 131/84 C; 131/84 R; 131/84 A

[58] Field of Search ..... 131/21 D, 84 A, 84 R, 131/84 C, 84 B

[56] References Cited

U.S. PATENT DOCUMENTS 3,032,041 5/1962 Lanore ..... 131/84 C

*Primary Examiner*—V. Millin

*Attorney, Agent, or Firm*—Peter K. Kontler

[57] ABSTRACT

Apparatus is provided for removing the surplus of tobacco fibrous material from one side of a continuous stream. The apparatus comprises conveyer means for moving the stream lengthwise so that one side of the stream remains exposed. Compressing means are further provided for compacting spaced-apart portions of the moving stream. The apparatus further includes filler segregating means including at least one rotary disc having a marginal portion extending into the moving stream wherein the marginal portion includes at least one pocket having an open side facing the exposed side of the stream with the surplus of fibrous material extending beyond the marginal portion. Means are further provided for rotating the disc at a peripheral speed which at least closely approximates the speed of the lengthwise movement of the stream. At least one pocket is arranged to receive and temporarily confine parts of the compacted portions of the stream. Means are further provided for separating the material which extends beyond the marginal portion and is not confined in the pocket so that the thus treated stream is converted into a filler having portions which correspond to the spaced-apart portions of the stream and each of which contains a larger quantity of fibrous material and the remaining portions of the filler as a result of the compacting action of the compressing means and the temporary confinement of the spaced-apart portions of the pocket.

17 Claims, 10 Drawing Figures

Fig. 7
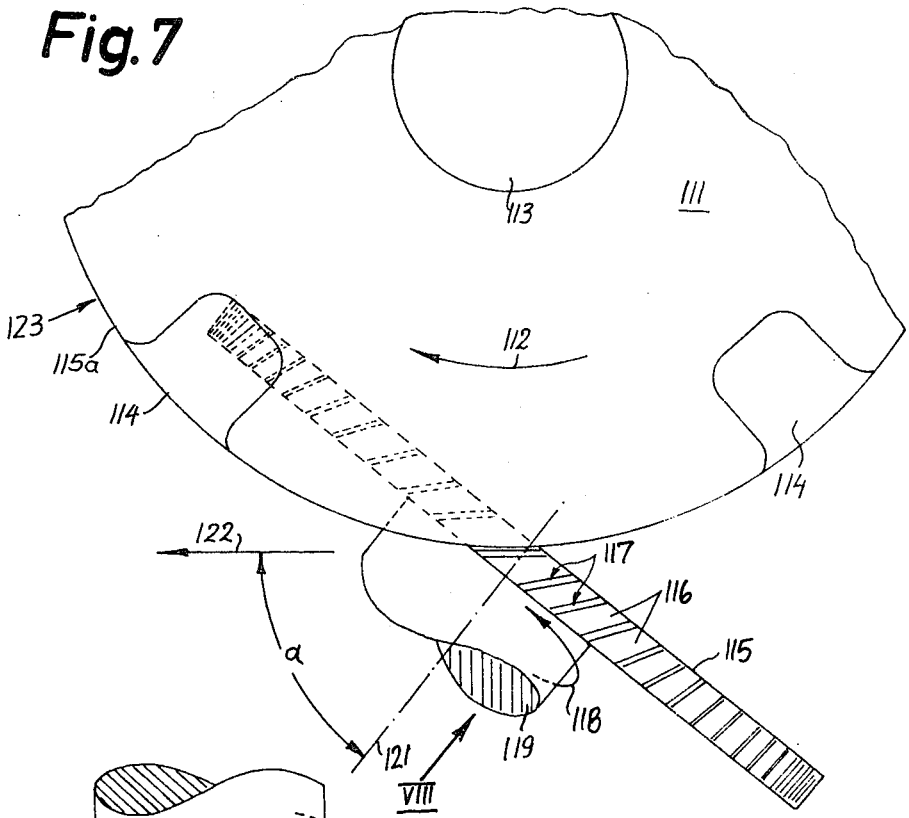
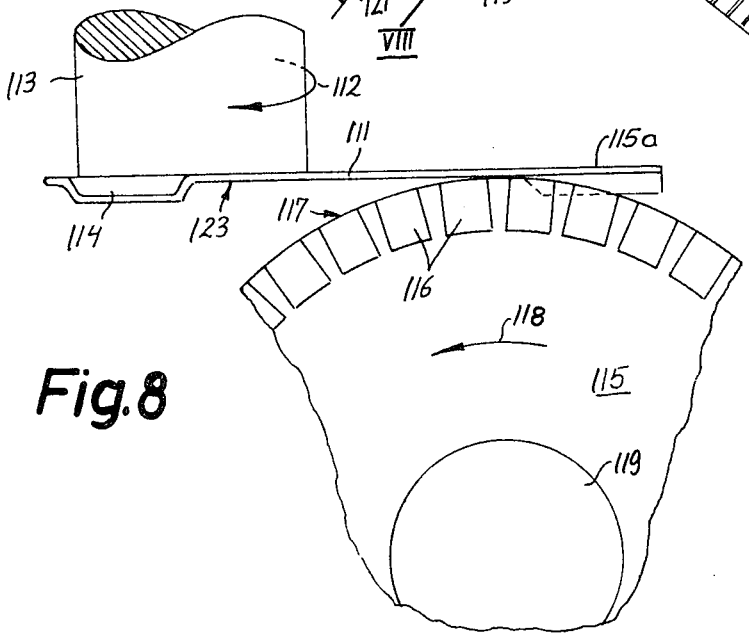
Fig. 8

APPARATUS FOR MAKING FILLERS FOR ROD-SHAPED SMOKERS' PRODUCTS HAVING DENSE ENDS

BACKGROUND OF THE INVENTION

The present invention relates to machines for making rod-shaped smokers' products with dense ends, and more particularly to improvements in apparatus which are used in such machines to convert a stream consisting of tobacco particles or like fibrous material into a filler wherein portions containing larger quantities of fibrous material alternate with portions containing smaller quantities of such material. For the sake of convenience, the invention will be described with reference to the making of plain cigarettes having dense ends and consisting of natural tobacco; however, it will be understood that similar apparatus can be resorted to in the manufacture of filter tipped cigarettes as well as in the manufacture of plain or filter tipped cigarillos or cigars consisting of natural or reconstituted tobacco and/or tobacco substitutes.

There are two presently known methods of making cigarettes with dense ends. Both methods and the corresponding apparatus have found widespread acceptance in the industry for more than two decades. In accordance with the first method, a rotary cam or an analogous mechanical compacting device condenses spaced-apart (selected) portions of a continuous tobacco stream which is moved lengthwise into the range of a suitable trimming device which removes the surplus. The mechanically compacted portions of the thus obtained filler contain more tobacco than the remaining portions of the filler The means for conveying the stream past the mechanical compacting device preferably comprises a suction-operated conveyor, and the compacting device is arranged to condense the selected portions of the stream in a direction toward the suction-operated conveyor. The extent of mechanical compacting of selected portions of the stream can be such that the trimming device is incapable of removing any tobacco from the mechanically compacted portions of the stream. The filler is thereupon draped into a web of cigarette paper of other suitable wrapping material to form therewith a continuous cigarette rod which is severed to yield a succession of plain cigarettes having dense ends. The severing (by a conventional cutoff or the like) can take place adjacent to or across the densified portions, depending upon whether the cigarettes should have one or two dense ends.

An apparatus of the just outlined character is disclosed in U.S. Pat. No. 3,318,314 granted May 9, 1967 to Carl Stelzer.

In accordance with the second method, the means for removing the surplus from selected portions of a continuous tobacco stream comprises a trimming device which is designed to alternately remove larger and smaller quantities of tobacco from one side of a moving stream. This is accomplished by resorting to one or more discs having marginal portions provided with pockets for additional tobacco. The discs rotate at a peripheral speed matching the forward speed of the stream and cooperate with a surplus removing or separating device, e.g., a brush or a paddle wheel which sweeps away all particles of tobacco extending beyond the marginal portion or portions of the disc or discs. The resulting filler has portions of greater height or thickness alternating with portions of lesser height or thickness; it is converted into a rod which is wrapped in cigarette paper, and the resulting continuous cigarette rod is severed across or adjacent to portions which contain more tobacco to yield a file of plain cigarettes with one or two dense ends.

An apparatus which can be used for the practice of the just outlined second method is disclosed in U.S. Pat. No. 3,032,041 granted May 1, 1962 to Raymond Lanore.

Under certain circumstances, neither of the above outlined prior methods and apparatus is likely to produce dense-end cigarettes with a requisite degree of accuracy and reliability. This holds true especially when the cigarettes are to be manufactured at a rate of approximately or even in excess of one hundred per second, a requisite which is met by certain presently known cigarette makers such as a machine now marketed by the assignee of the present application.

OBJECTS AND SUMMARY OF THE INVENTION

An object of the invention is to provide a novel and improved apparatus which can convert a continuous stream of tobacco or other fibrous material into a filler wherein portions containing larger quantities of fibrous material alternate with portions containing smaller quantities of fibrous material and wherein such conversion can be carried out at a rate which suffices to turn out up to and in excess of one hundred rod-shaped smokers' products per second.

Another object of the invention is to provide an apparatus of the above outlined character whose operation is more reliable than that of heretofore known apparatus, especially when the conversion of a continuous stream of fibrous material into a continuous filler with alternating portions which respectively contain larger and smaller quantities of fibrous material must be effected at an extremely high speed.

A further object of the invention is to provide a novel and improved method of converting a continuous tobacco stream which contains a surplus of tobacco particles (e.g., shreds of tobacco leaf laminae) into a continuous filler having alternating portions which respectively contain larger and smaller quantities of tobacco.

An additional object of the invention is to provide the apparatus with novel and improved means for ensuring that spaced-apart portions of the filler will contain more tobacco than the remaining portions of the filler.

Another object of the invention is to provide novel and improved tobacco removing means for use in the apparatus of the above outlined character.

The invention is embodied in an apparatus for removing the surplus of tobacco or like fibrous material from one side of a continuous stream of fibrous material. The apparatus comprises conveyor means (preferably an overhead pneumatic conveyor) for moving the stream of fibrous material lengthwise so that the one side of the stream remains exposed (i.e., such one side is accessible for removal of the surplus and/or for other treatment of the stream), compressing means (e.g., a rotary cam with one, two or more lobes) for compacting spaced-apart portions of the moving stream, filler segregating means including at least one rotary disc having a marginal portion which extends into the moving stream and is provided with at least one pocket so that the surplus of fibrous material extends beyond the marginal portion of the disc, means for rotating the disc at a peripheral speed which at least closely approximates the speed of lengthwise movement of the stream whereby the pocket or pockets receive parts of the compacted portions of the stream, and a rotary cutter, brush, paddle wheel or analogous means for separating the surplus which extends beyond the disc so that the thus treated stream is converted into a filler having portions which correspond to the compacted or condensed portions of the stream and each of which contains a larger quantity of fibrous material than the remaining portions of the filler. The latter is then wrapped in cigarette paper or the like to form therewith a continuous rod which is severed at regular intervals to yield plain cigarettes, cigarillos or cigars of unit length or multiple unit length.

The marginal portion of the disc is preferably sharp and/or serrated so that it can enhance or assist the cutting action of the separating means (or performs the cutting action) and/or that it can properly grip the fibrous material between the surplus (which is to be removed) and the material which is to form the filler.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 7 is a top plain view as seen in the direction of arrow VII in FIG. 5;

FIG. 8 is an end elevational view as seen in the direction of arrow VIII of FIG. 7;

DESCRIPTION OF THE PREFERRED EMBODIMENTS

Figure 1:
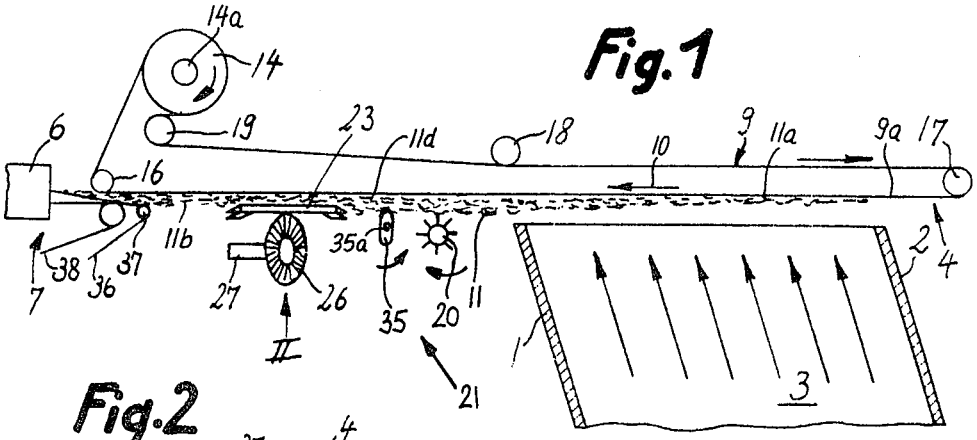
FIG. 1 is a fragmentary schematic partly side elevational and partly longitudinal sectional view of a cigarette making machine embodying an apparatus which is constructed and assembled in accordance with a first embodiment of the invention.

FIG. 1 shows a portion of a cigarette making machine wherein a shower of tobacco particles is drawn or blown up a duct 3 between the walls 1 and 2 to form a growing tobacco stream 11*a* at the underside of the lower reach 9*a* of an endless foraminous conveyor belt 9. The belt 9 forms part of a pneumatic conveyor 4 which advances the growing stream 11*a* in the direction of arrow 10. The fully grown tobacco stream 11 continues to advance in such direction and contains a surplus of tobacco particles, i.e., the quantity of fibrous material in each and every increment or unit length of the fully grown stream 11 is greater than the maximum quantity needed for the making of an increment of a tobacco filler 11*b*. In the embodiment of FIG. 1, the duct 3 conveys a shower of tobacco particles which are advanced by suction. The filler 11*b* is advanced in the direction of arrow 10 to enter a wrapping mechanism 6 and to be draped into a web 36 of cigarette paper or other suitable wrapping material to form therewith a continuous cigarette rod (not shown) which is thereupon severed at predetermined intervals to yield plain cigarettes of desired length, e.g., plain cigarettes of twice unit length.

Figure 3:
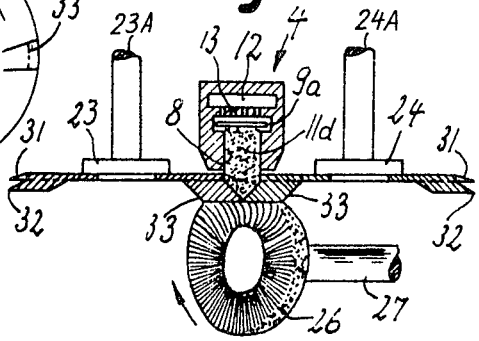
FIG. 3 is a composite sectional view as seen in the direction of arrows from the line III—III of FIG. 2.

The pneumatic conveyor 4 further comprises an elongated tobacco channel 8 (see FIG. 3) which preferably extends all the way to the receiving end of a transporting unit 7 serving to advance the filler 11*b*, the web 36 and the wrapped cigarette rod through and beyond the wrapping mechanism 6. The lower reach 9*a* of the conveyor belt 9 is guided in the channel 8 in such a way that it advances immediately or closely below the perforated bottom wall 13 of a suction chamber 12 which draws air through the lower reach 9*a* and thereby ensures that the growing stream 11*a*, the fully grown stream 11 as well as the filler 11*b* will adhere to and share the leftward movement of the lower reach 9*a*, as viewed in FIG. 1. The belt 9 is trained over and/or guided and/or tensioned by several idler rollers 16, 17, 18, 19 and a driven roller 14. The means for driving the roller 14 includes a shaft 14*a* which receives torque from the main prime mover of the cigarette making machine or from the common prime mover of two or more machines in a complete production line, e.g., from the common prime mover of the illustrated cigarette maker and of a filter tipping machine (e.g., a machine known as MAX 80 and manufactured by the assignee of the present application) which receives plain cigarettes from the machine of FIG. 1 and assembles such plain cigarettes with filter mouthpieces to form filter cigarettes of unit length or multiple unit length.

The exposed (accessible) underside 11*c* (see FIG. 4) of the fully grown tobacco stream 11 at the underside of the lower reach 9*a* of the conveyor belt 9 is uneven. Therefore, the fully grown stream 11 is preferably subjected to the equalizing action of elastic blades forming part of a driven paddle wheel 20 which is disposed downstream of the duct 3 and serves to shift the material of the hills into the valleys at the underside 11*c* of the fully grown stream 11. The surplus of tobacco particles is removed by an apparatus 21 which is constructed and assembled in accordance with a first embodiment of the invention. The apparatus 21 is disposed downstream of the equalizing device, i.e., between the paddle wheel 20 and the wrapping mechanism 6, and serves to convert the equalized stream (shown at 11*d* in FIG. 1) into the filler 11*b* whose outline (as concerns the underside thereof) is indicated in FIG. 4 by a broken line BL.

Figure 4:
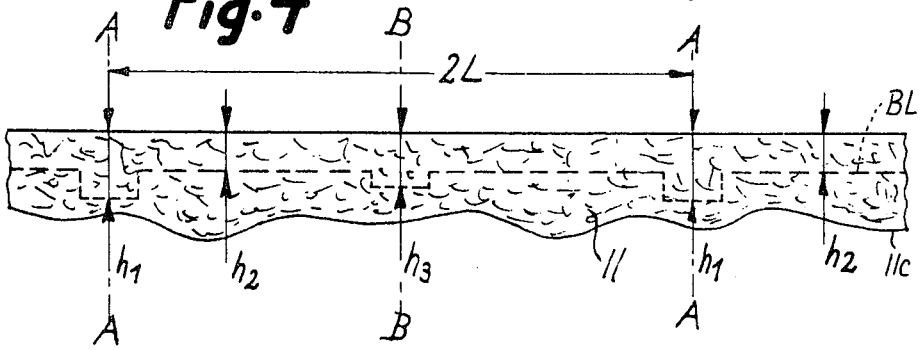
FIG. 4 is a greatly enlarged schematic longitudinal sectional view of the tobacco stream in the machine of FIG. 1, the outline of the bottom surface of the stream prior to removal of the surplus being indicated by a solid line and the outline of the filler being indicated by a broken line.

The cigarette making machine of FIG. 1 is designed to produce plain cigarettes of double unit length 2L (see FIG. 4). The planes in which the wrapped cigarette rod is severed downstream of the wrapping mechanism 6 are indicated by phantom lines A—A. Each plain cigarette of double unit length is severed midway between its ends in a filter tipping machine which follows the cigarette making machine, the thus obtained plain cigarettes of unit length are moved apart to provide room for filter plugs of double unit length, the plain cigarettes are moved axially toward each other to abut against the respective ends of the corresponding filter plug of double unit length, and an adhesive-coated uniting band is draped around each group of three coaxial components, namely, the two spaced-apart plain cigarettes of double unit length and the filter plug of double unit length therebetween. The resulting filter cigarette of double unit length is severed midway between its ends to yield two filter cigarettes of unit length each of which includes a plain cigarette of unit length, a filter plug of unit length, and one-half of a convoluted uniting band which sealingly connects the filter plug to the plain cigarette. The plane in which a plain cigarette of double unit length (2L) is severed to yield two coaxial plain cigarettes of unit length is shown in FIG. 4, as at B—B. The treatment of plain cigarettes, filter plugs and filter cigarettes in the filter tipping machine preferably takes place while such components are caused to move sideways, i.e., at right angles to their respective longitudinal axes.

The purpose of the surplus removing apparatus 21 is to ensure that at least one end of each plain cigarette of unit length will contain more tobacco than the major part of the respective plain cigarette. This is achieved by removing from the equalized stream 11*d* larger quantities of tobacco in regions which are to constitute the intermediate portions of the rod-like fillers of plain cigarettes and more tobacco in the region or regions of one or both ends of cigarette fillers. With reference to FIG. 4, the major (median) portion of each plain cigarette of unit length or double unit length will contain the smallest quantity of tobacco; therefore, the equalized stream 11*d* is trimmed in such a way that the height of the filler 11*b* in the region of such major portion of each filler section which is to constitute the filler of a cigarette will equal $h_2$. The reference characters $h_1$ denote the height of those portions of the filler 11*b* which are to form the ends of the filler of a plain cigarette of double unit length 2L. The reference character $h_3$ denotes the height of that portion of the tobacco filler which is to be severed in the plane B—B so that a plain cigarette of double unit length yields two plain cigarettes of unit length. It will be noted that $h_1$ exceeds $h_3$ and that $h_3$ exceeds $h_2$. In other words, each plain cigarette of unit length will have a filler including a denser first and a less dense second end portion as well as a mediam portion whose density is less than the density of the second end portion. The (first) end portions of greater density (see $h_1$ in FIG. 4) will be disposed at those ends of filter cigarettes of unit length which are to be lighted, i.e., the (second) end portions of lesser density (see $h_3$ in FIG. 4) will be adjacent to the filter plugs of the filter cigarettes of unit length.

Figure 2:
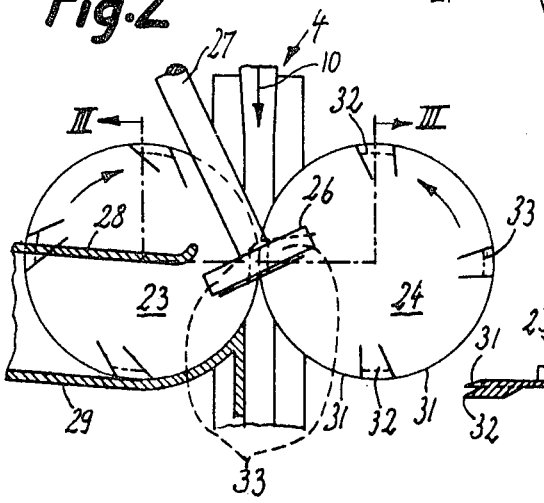
FIG. 2 is an enlarged bottom plan view of a detail as seen in the direction of arrow II in FIG. 1.

The surplus removing apparatus 21 comprises two coplanar filler segregating discs 23 and 24 which are driven to rotate in opposite directions (this is indicated by the arrows shown in FIG. 2). The marginal portions of the discs 23 and 24 are sharp (see FIG. 3) so that they can readily clamp (and even partially or completely sever) fragments of tobacco which extend downwardly beyond the discs 23 and 24. Such fragments constitute the surplus which is fully separated from the equalized stream 11*d* by a rotary separating device here shown as a cylindrical brush 26 driven by a shaft 27 to rotate in the direction indicated by the arrow shown in FIG. 3 and being disposed in the region below the area where successive increments of marginal portions of the discs 23, 24 meet (or even slightly overlap) when the discs are driven by their respective shafts 23A, 24A. The shaft 27 is preferably driven at a relatively high and constant speed by a discrete prime mover, i.e., independently of the shafts 23A, 24A. These shafts are driven in synchronism with the shaft 14*a* for the roller 14 so that the speed of lengthwise movement of the stream 11 matches the speed of marginal portions of the discs 23 and 24. FIG. 2 shows that the bristles of the brush 26 are disposed in one or more planes which are normal to the axis of the shaft 27 and make an oblique angle with the direction (arrow 10) of lengthwise movement of the tobacco stream 11 and filler 11*b* with the lower reach 9*a* of the conveyor belt 9. The major part of the separating action (as concerns the removal of surplus from the equalized stream 11*d*) an be performed by the sharp edges of marginal portions of the discs 23, 24, i.e., the bristles of the brush 26 can be used to sweep partially or completely separated fragments of tobacco away from the undersides of the discs 23, 24 in the space below the region where successive increments of the marginal portions of these discs meet when the apparatus 21 is in use. The removed surplus of tobacco descends or is drawn or blown into a take-off conveyor, e.g., a pneumatic conveyor pipe including the walls 28 and 29 shown in FIG. 2. Such tobacco is normally returned to the magazine of a customary distributor (not shown) in the cigarette making machine. It is not necessary that the conveyor including the walls 28, 29 return the removed surplus all the way to the just mentioned magazine.

The marginal portions of the discs 23, 24 have sections which are located at three different levels, i.e., in three different planes. These planes are selected in such a way that the discs 23, 24 cooperate with one another and with the brush 26 to remove the surplus of tobacco particles at the distances $h_1$, $h_2$ and $h_3$ from the underside of the lower reach 9*a* of the conveyor belt 9. Those sections of marginal portions of the discs 23, 24 which cooperate with each other and with the brush 26 to remove tobacco particles at the distance $h_2$ from the lower reach 9*a* of the conveyor belt 9 are shown at 31. Those sections of marginal portions of the discs 23, 24 which cooperate with each other and with the brush 26 to respectively remove tobacco particles at distances $h_1$ and $h_3$ from the lower reach 9*a* of the conveyor belt 9 are respectively shown at 33 and 32. The sections 32 define relatively shallow pockets in the upper sides of the discs 23, 24 to provide room for additional tobacco particles which are to form protuberances in the planes B—B, and the sections 33 define relatively deep pockets which provide room for additional tobacco particles forming protuberances of the filler 11*b* in the planes A—A. The pockets which are defined by the sections 32 and 33 of the marginal portions of the disc 23 or 24 alternate with and are spaced apart by 90 degrees from each other, as considered in the circumferential direction of the respective disc. Each section 32 of the disc 23 approaches and cooperates with a section 32 of the disc 24 when these sections are to form a protuberance in the region of a plane B—B, and each section 33 of the disc 23 approaches and cooperates with a section 33 of the disc 24 when these sections are to form a protuberance in the region of a plane A—A. The sections 31 of the discs 23, 24 cooperate to form those portions of the filler **11*b* whose height equals $h_2$. The length of that portion of the equalized stream 11*d* which has passed beyond the common plane of the discs 23, 24 in response to one full revolution of each of these discs equals 2L, i.e., the length of the corresponding filler portion equals the combined length of two plain cigarettes of unit length. As mentioned above, the peripheral speed of the disc 23 and/or 24 matches the speed of lengthwise movement of the conveyor belt 9, i.e., of the stream 11 and filler 11*b*. The protuberances in the planes B—B are formed upon rotation of the discs 23, 24 through 90 degrees beyond the positions of FIG. 2. In the positions of FIG. 2, the discs 23, 24 cooperate with the brush 26 to form a protuberance having a height $h_1$, and such protuberance is formed again when the discs 23, 24 are turned through 180 degrees beyond the positions shown in FIG. 2**.

It is clear that the distribution of sections 31, 32, 33 in a manner as shown in FIG. 2 is but one of several possible arrangements. Thus, the number of sections 32 and 33 can be increased to three, four, etc. if the diameters of the discs 23, 24 are increased accordingly so that the length of the sections 31 between the two neighboring sections 32, 33 equals the desired length of a plain cigarette of unit length. Also, the number of sections 32 and 33 on each of the discs 23, 24 can be reduced to one if the diameters of these discs are so small that each thereof must complete one-half of a full revolution during the interval of advancement of the filler **11*b*** through a distance which equals L, i.e., the length of a plain cigarette of unit length.

The marginal portions of the discs 23, 24 can closely approach, contact or slightly overlap each other in the region of the central longitudinal vertical symmetry plane of the pneumatic conveyor 4.

It is highly desirable to ensure that the density of each protuberance in the filler **11*b* match or closely approximate a preselected optimum density. Such density should suffice to guarantee that tobacco particles will not escape at the tobacco-containing ends of filter cigarettes subsequent to conversion of pairs of plain cigarettes of unit length and discrete filter plugs of double unit length into filter cigarettes of double unit length. Also, the protuberances should not wander in the longitudinal direction of the filler 11*b***. Such wandering or shifting, too, is prevented (or its extent reduced) if the density of protuberance matches or closely approximates a desired value. A protuberances in one of the planes A—A should contain the same quantity of tobacco as a protuberance in any other plane A—A. Analogously, the quantity of tobacco in each of the protuberances disposed in the regions of the planes B—B should be the same (but such density need not be identical with the density of a protuberance in the region of a plane A—A).

The just described requirement can be met with a higher degree of predictability if the apparatus 21 further comprises a compacting or compressing device which condenses the stream **11*d* in the regions of the planes A—A and B—B before the thus condensed portions of the stream 11 reach the space between the axes of the discs 23, 24, namely, before the thus condensed portions of the stream 11*d* are relieved of their surplus by the sections 32 or 33 in cooperation with the brush 26. The compacting or compressing means of the surplus removing apparatus 21 comprises a mechanical compacting or device, namely, a rotary cam 35 with two lobes which is driven by its shaft 35*a* to rotate in the direction indicated by the arrow shown in FIG. 1. The speed of the cam 35** is selected in such a way that its lobes compact or condense those portions of the stream ll*d* which are about to form protuberances in the planes A—A and B—B. The lobes of the cam 35 urge the particles of tobacco toward the underside of the lower reach **9*a* of the conveyor belt 9. The compacting action is quite pronounced in the region of the exposed (accessible) underside 11*c* of the stream 11*d* whereby the porosity of the condensed portions of the stream 11*d* decreases and the suction chamber 12 is capable of attracting the corresponding portions or parts of the stream 11*d* with a greater force, i.e., such portions of the stream 11*d* remain compacted during transport toward the nip of the discs 23, 24**.

At least in certain instances, the lobes of the cam 35 can compact the stream **11*d* only in those regions which are disposed in and adjacent to the planes A—A, i.e., the portions in the planes B—B need not be compacted or condensed upstream of the discs 23, 24 if the required density of the non-exposed ends of tobacco-containing portions of filter cigarettes need not be very pronounced. The manner in which the shaft 35*a* is driven to ensure that the lobes of the cam 35 condense the stream 11*d* in the region of each plane A—A or in the region of all planes A—A and B—B, i.e., the manner of synchronizing the angular movement of the cam 35 with angular movements of the discs 23, 24 and with angular movement of the driven roller 14 for the conveyor belt 9** is the same as is well known from the art of cigarette making and filter cigarette making machines to ensure proper timing of movements of various parts which act upon the component parts of plain cigarettes or filter cigarettes.

Successive increments of the filler **11*b* advance beyond the pneumatic conveyor 4, i.e., beyond the idler roller 16, and are transferred onto the upper side of the cigarette paper web 36 which is moved forwardly by the upper reach of a garniture 38 forming part of the transporting unit 7. The wrapping mechanism 6 includes means for converting the filler 11*b* into a rod of constant diameter and for draping the web 36 around such rod to form the aforementioned continuous cigarette rod which is severed by a cutoff (not shown) in successive planes A—A to yield plain cigarettes of double unit length. The reference character 37 of FIG. 1 denotes a roller which deflects the cigarette paper web 36 toward and onto the upper reach of the garniture 38**.

It is clear that the surplus removing apparatus 21 need not be disposed at the underside of the lower reach **9*a* of the conveyor belt 9. If the duct 3 is designed to deliver tobacco particles to the upper reach of the belt 9, i.e., if the suction chamber 12 is installed below the upper reach of this belt, the surplus removing apparatus 21 is mounted at a level above the conveyor belt. Also, the brush 26** can be replaced by a separating device wherein the bristles are replaced by or provided in addition to elastic flaps or strips (i.e., by a simple or specially designed paddle wheel) without departing from the spirit of the invention.

The equalizing device 20 is desirable and advantageous because it reduces the unevenness of the underside Q1*c* of the stream 11 before the latter reaches the cam 35. This contributes to greater uniformity of density of each and every portion of the filler 11*b*, especially to uniform density of the portions having the height $h_2$.

At a first glance, the provision of the condensing cam 35 in addition to the discs 23, 24 appears to be unnecessary because a simple conventional trimmer without any pockets could remove the surplus subsequent to selective compacting of longitudinally spaced-apart portions of a continuous tobacco stream. In other words, one would expect the discs 23, 24 and the brush 26 to constitute a satisfactory apparatus for removal of the surplus in such a way that the resulting filler would exhibit protuberances in the region of each plane where the cigarette rod is to be severed so as to yield plain cigarettes of desired length. By the same token, one would expect the cam 35 and a simple trimmer to suffice for conversion of a tobacco stream into a filler wherein longitudinally spaced-apart portions contain more tobacco than the portions therebetween. Furthermore, one would expect that, once the lobes of the cam 35 have compacted certain portions of the stream 11, the quantity of tobacco particles left for removal by the brush 26 in cooperation with the sections 32 and/or 33 of marginal portions of the discs 23, 24 (depending upon whether the lobes of the cam 35 condense the stream 11 in the planes B—B and/or A—A) would be zero. Thus, one could expect that the compacting action of lobes on the cam 35, combined with the resulting more pronounced attraction of corresponding compacted portions of the stream 11*d* by the suction chamber 12, would suffice to ensure that the compacted portions of the stream 11*d* *would remain compacted during travel toward and with the sections 32, 33 of the discs 23, 24 so that the surplus of tobacco would extend solely beyond the sections 31.*

Extensive experiments with the apparatus of FIGS. 1–4 indicate that, quite surprisingly, the quality of dense-end cigarettes is much more predictable if the compacting means (such as the cam 35) is used together with the discs 23, 24, i.e, with a device which could remove more or less tobacco from certain portions of the tobacco stream irrespective of whether or not such selected portions were compacted ahead of the surplus removing brush and disc or discs. The just mentioned experiments further indicate that the quality of dense-end cigarettes is especially satisfactory if the cigarettes are produced in recent types of mass-producing machines, namely, in machines which can turn out in excess of 5000 and even up to and in excess of 6000 cigarettes per minute. Otherwise stated, the difference between a surplus removing apparatus which merely employs the parts 23, 24, 26 or the part 35 in combination with a plain trimmer on the one hand, and the surplus removing apparatus of the present invention on the other hand, is especially pronounced when the rate of making dense-end cigarettes is very high.

Another important advantage of the improved apparatus is that the density of protuberances in the planes where the filler is to be severed subsequent to wrapping is more predictable than if the filler is formed by resorting solely to the parts 23, 24, 26 or to the part 35 in combination with a plain trimmer. This will be readily appreciated since the cam 35 is installed downstream of the coarse equalizing device 20 so that the height of the surplus-carrying stream 11*d* which advances beyond the device 20 is reasonably constant. Consequently, the densifying action of lobes on the cam 35 is also more or less uniform with the result that the quantity of tobacco in all larger protuberances (having the height $h_1$) is the same and the quantity of tobacco in each protuberance having the height $h_3$ is also the same (but need not necessarily match that of tobacco quantities in the planes A—A).

When the parts 23, 24, 26 are used without the cam 35 or other mechanical or otherwise constructed compacting means, the extent to which the pockets defined by the sections 32 and 33 of marginal portions of the discs 23, 24 are filled with tobacco becomes less and less predictable as the speed of forward movement of the stream 11 (and hence the peripheral speed of the discs 23, 24) increases.

FIGS. 5 to 8 illustrate a portion of a second surplus removing apparatus. This apparatus also comprises a compacting device which is identical with or a functional equivalent of the cam 35 shown in FIG. 1 but is not illustrated in FIGS. 5–8.

Figure 5:
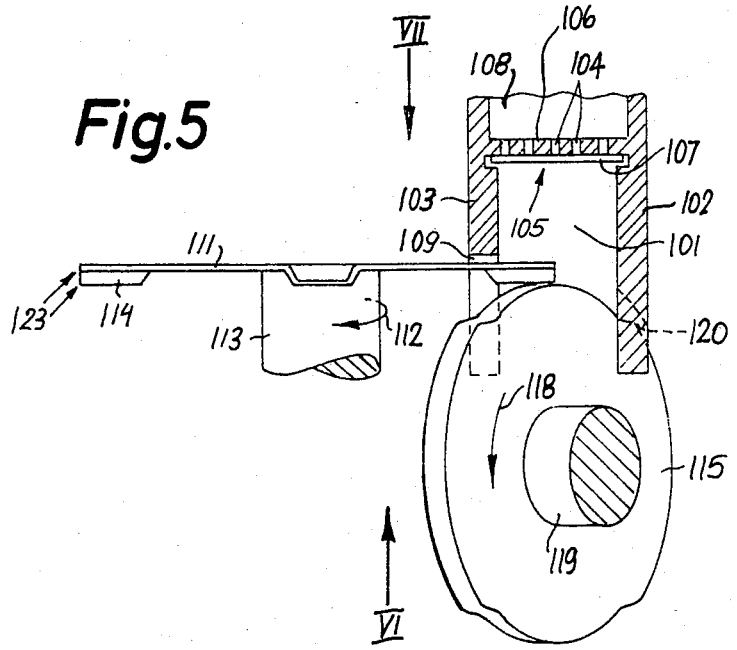
FIG. 5 is a fragmentary transverse vertical sectional view of a cigarette making machine embodying a modified surplus removing apparatus with a single disc, the section being taken in the direction of arrows as seen from the line V—V of FIG. 6.

As shown in FIG. 5, the machine which embodies the apparatus of FIGS. 5 to 8 comprises a modified pneumatic conveyor 105 which includes a tobacco channel 101 having two parallel side walls 102, 103 below a perforated top wall 106 whose holes are shown at 104. The suction chamber 108 is located above the top wall 106 and serves to attract a growing and thereupon a fully grown tobacco stream against the underside of the lower reach of an endless foraminous conveyor belt 107; this lower reach is disposed immediately below the underside of the top wall 106.

The surplus removing apparatus comprises the aforementioned compacting cam or an analogous compacting device (not shown) and a single disc 111 which extends into the channel 101 through a window or cutout 109 in the side wall 103. The disc 111 is driven by a shaft 113 rotating in the direction of arrow 112. The general plane of the disc 111 is parallel to the plane of the lower reach of the conveyor belt 107 in the channel 101 (this also applies for the general planes of the discs 23, 24 and the lower reach 9*a* of the belt 9, see FIG. 3). The marginal portion 123 of the disc 111 has four equidistant pockets (see particularly FIG. 6) which are defined by sections 114 located at a level below the remaining (longer) sections 115 with reference of the marginal portion 123. The depth of each pocket may but need not be the same, depending upon whether the manufacturer desires to produce plain cigarettes with two equally dense ends or plain cigarettes wherein one end contains more tobacco than the other end. The distance between the sections 114 and the lower reach of the belt 107 exceeds the distance between this lower reach and the sections 115 with reference so that the pockets which are defined by the sections 114 receive and confine additional tobacco, namely, tobacco which has been compacted by the non-illustrated cam or a like condensing or compacting device. The depth of the cutout or window 109 in the side wall 103 is such that the sections 114, 115 with reference of the marginal portion 123 of the disc 111 can be placed at a desired distance from the lower reach of the belt 107.

The disc 111 cooperates with a surplus removing or separating device in the form of a milling cutter 115 with peripheral grooves 116 which alternate with cutting edges 117 (see particularly FIG. 7). The depth of the grooves 116 (as considered in the radial direction of the cutter 115) and the width of such grooves (as considered in the circumferential direction of the cutter) is preferably less than the width of the channel 101. If the depth of the grooves 116 were quite pronounced, they would be likely to permit the development of undesirable air streams (induced by the suction chamber 108). Also, such undesirable air streams would be likely to develop if the grooves 116 were relatively deep and the cutter 115 were driven at a high speed.

The thickness (axial length) of the cutter 115 is preferably less than the width of the tobacco channel 101, and the end faces of the cutter are preferably smooth. A portion of this cutter extends into the channel 101 at a level below the disc 111 through an opening or window 120 in the side wall 102 of the channel 101. The opening 120 is just large enough to permit entry of a portion of the cutter 115 into the channel 101.

The means for driving the cutter 115 comprises a shaft 119 which rotates in the direction indicated by arrow 118. The plane of the cutter 115 is normal to the plane of the lower reach of the conveyor belt 107.

As shown in FIG. 7, the axis 121 of the shaft 119 for the cutter 115 makes an acute angle alpha with the longitudinal direction (arrow 122) of the lower reach of conveyor belt 107 and with the longitudinal direction of the tobacco stream at the underside of the lower reach of this belt. The inclination of grooves 116 in the periphery of the cutter 115*a* to the axis 121 of the shaft 119 is the same. Consequently, the cutting edges 117 are parallel to the longitudinal direction of the belt 107 (arrow 122) in the region where they cooperate with the sections 114, 115*a* of the marginal portion 123 of the disc 111.

Figure 6:
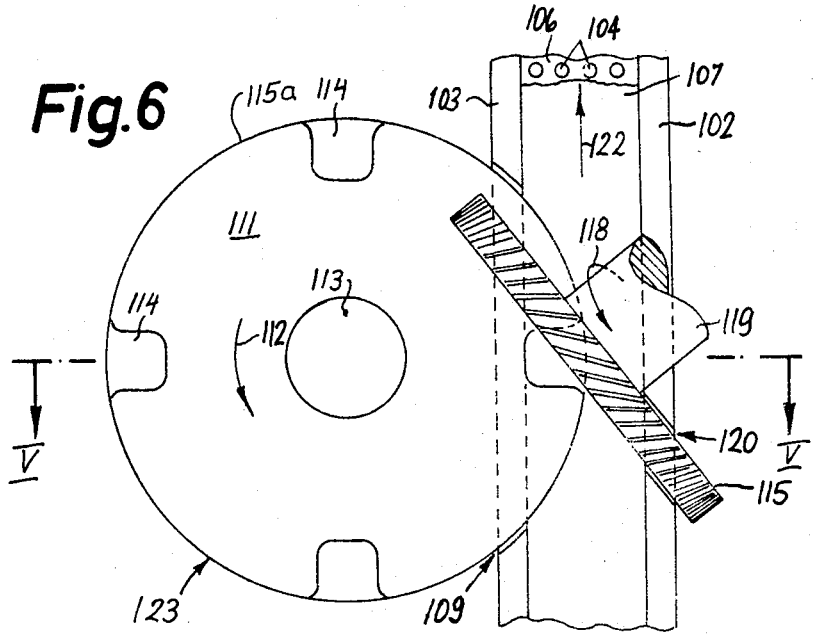
FIG. 6 is a bottom plan view as seen in the direction of arrow VI in FIG. 5.

As shown in FIGS. 5 and 6, the disc 111 penetrates into the channel 101 and hence into the tobacco stream at the underside of the lower reach of the conveyor belt 107. The disc 111 extends through the window 109 of the side wall 103. The cutter 115 extends into the channel 101 from the other side (through the window 120 of the side wall 102) and pushes the surplus of tobacco toward the marginal portion 123 so that such surplus is removed by the cutting edges 117 in cooperation with the sections 114, 115*a* of the marginal portion 123. The separated surplus is moved along the underside of the disc 111 and on to a take-off conveyor (not shown) which returns the particles into the magazine of the distributor.

The feature that the disc 111 and the cutter 115 extend into the channel 101 from opposite sides brings about the advantage that the cutter 115 forces tobacco particles into the pockets which are defined by the sections 114 of the marginal portion 123 so that such pockets are invariably filled with tobacco when the cutting edges 117 sever the surplus below the pockets. In other words, the cutter 115 urges tobacco particles toward and into the pockets before the surplus in the respective regions of the marginal portion 123 is removed by the cutting edges 117 in cooperation with the sections 114 and 115*a*. Therefore, those portions of the filler which are formed by the cutter 115 in cooperation with the sections 114 invariably contain more tobacco than the other portions of the filler. The thus obtained filler is then converted into a substantially cylindrical rod which is wrapped into cigarette paper prior to subdivision into plain cigarettes of unit length or multiple unit length. The denser portions of the filler are confined in or adjacent to those portions of the cigarette paper web which are severed during subdivision of the continuous cigarette rod into discrete plain cigarettes, i.e., each plain cigarette has one or two dense ends.

Figure 9:
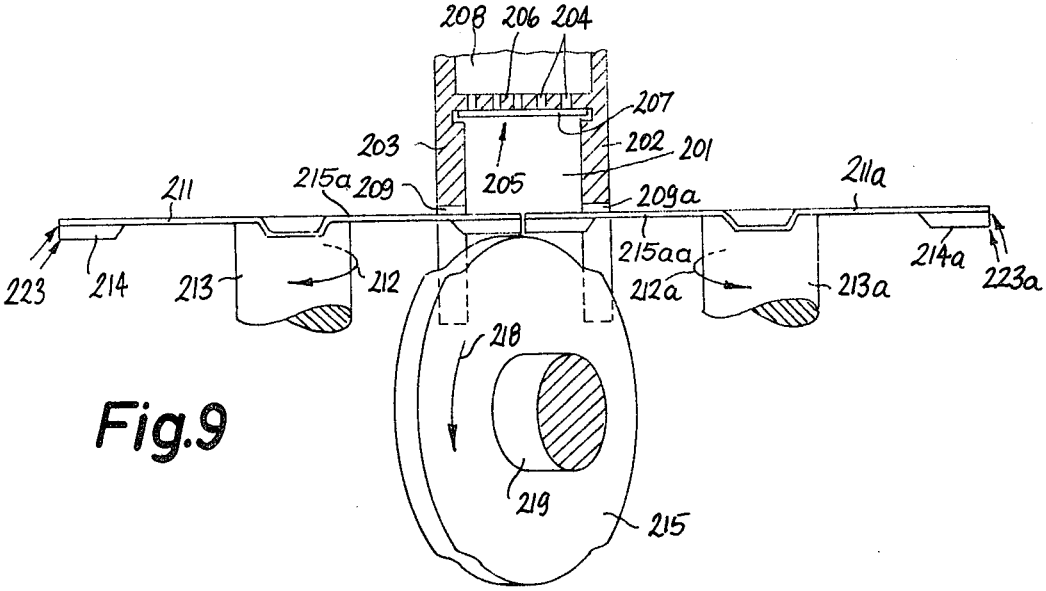
FIG. 9 is a fragmentary transverse vertical sectional view of a cigarette making machine which embodies a third apparatus with two discs and a surplus removing cutter of the type used in the embodiment of FIGS. 5 to 8.

FIG. 9 illustrates a portion of a surplus removing apparatus which embodies two discs (211, 211*a*) exhibiting the features of the disc 111 shown in FIGS. 5–8. Thus, the angle between the axis of the shaft 219 of the cutter 215 and the direction of lengthwise movement of the belt 207 in the pneumatic conveyor 205 is the same as the angle between the axis of the shaft 219 and the cutting edges (not shown) at the periphery of the cutter. This ensures that the cutting edges are parallel to the longitudinal direction of the belt 207 while they cooperate with the marginal portion 223 or 223*a* or the disc 211 or 211*a* to remove the surplus from the tobacco stream which is caused to adhere to the underside of the lower reach of the belt 207 because such lower reach travels below the perforated top wall 206 of the channel 201. The latter has side walls 202, 203, and the top wall 206 has holes 204 for the flow of air into the suction chamber 208. The side walls 202, 203 are respectively provided with windows 209, 209*a* for portions of the discs 211, 211*a*. The cutter 215 is located at a level below the discs 211, 211*a* and is driven by its shaft 219 to rotate in the direction of arrow 218. The grooves and cutting edges in the periphery of the cutter 215 are not specifically shown in FIG. 9. The arrows 212, 212*a* respectively denote the directions in which the shafts 213, 213*a* of the discs 211, 211*a* are driven when the apparatus of FIG. 9 is in use. The discs 211 and 211*a* rotate in the opposite directions, the same as the discs 23, 24 of the apparatus 21 shown in FIGS. 1 to 3. These discs are generally coplanar and each section 214*a* of the marginal portion 223*a* of the disc 211*a* cooperates with the oncoming section 214 of the marginal portion of the disc 211 to partially separate the surplus from protuberances at the underside of the filler which is obtained as a result of removal of surplus tobacco from the stream into which the marginal portions 223, 223*a* of the discs 211, 211*a* penetrate.

When the apparatus of FIG. 9 is in use (the discs 211, 211*a* are installed downstream of a compacting device, such as the cam 35 of FIG. 1, which condenses tobacco in the regions which are thereupon engaged by the sections 214, 214*a*), the sections 214, 215*a* and 214*a*, 215*aa* of the marginal portions 223, 223*a* press against the tobacco in the central zone of the channel 201 above the cutter 215. Since the cutter 215 is relatively small and relatively thin, and since the cutting edges at the periphery of the cutter 215 are tangential to the marginal portions 223, 223*a* of the discs 211, 211*a* in the regions where such cutting edges remove the surplus of tobacco, the shreds are severed cleanly so that the formation of dust is negligible. Satisfactory cutting action in the region of cooperating sections at the peripheries of the discs 211, 211*a* is desirable because, otherwise, the cutting edges of the cutter 215 could withdraw tobacco shreds from the pockets thereabove, i.e., the quantity of tobacco in such pockets could or would vary from pocket to pocket. Also, unsatisfactory severing of tobacco shreds, or the absence of any severing action, could result in accumulations of tobacco shreds in the zone immediately adjacent to the nip of the discs 211, 211*a*. Such shreds would circulate along endless paths and would ultimately move away from the disc 211.

The cutter 115 or 215 (with the aforedescribed orientation of its cutting edges) is especially desirable when the surplus removing apparatus comprises only one disc (such as the disc 111 of FIGS. 5–8). The cutting edges of the cutter 115 or 215 push the fibrous material of the stream against the marginal portion 123 of the disc 111 or against the marginal portion 223 of the disc 211 in a direction substantially at right angles to the direction of lengthwise movement of the tobacco stream in the channel 101 or 201. This enhances the separating action of the marginal portion (123 or 223) and cutter (115 or 215), especially if the cutter is relatively thin (i.e., if the thickness of the cutter is less than the width of the channel 101 or 201). Moreover, the cutting edges of the cutter 115 or 215 force the fibrous material into the pockets of the marginal portion 123 or 223 to thus further enhance the likelihood of establishment of uniform density of the filler in the region of each cutting plane.

Figure 10:
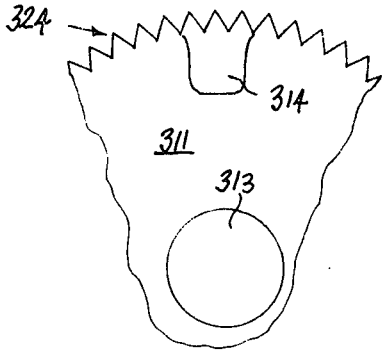
FIG. 10 is a fragmentary plan view of a modified disc which can be used in the apparatus of the present invention.

FIG. 10 shows a portion of a modified disc 311 which has a toothed marginal portion 324 and pockets defined by sections 314 located in a plane which is spaced apart from the general plane of the toothed periphery. The disc 311 (which is driven by a shaft 313) can be used as a superior substitute for the disc 23 or 24, and especially as a superior substitute for the disc 111 or for the discs 211, 211*a*. The marginal portion 324 of the disc 311 can be roughened in a number of other ways, i.e., not necessarily or exclusively by the provision of teeth or similar serrations. All that counts is to roughen the marginal portion of the single disc or the marginal portions of a pair of discs to further reduce the likelihood of slippage of such marginal portions relative to the tobacco stream in the region between the material which is to form the filler and the material which is to form the surplus. The serrations of teeth further reduce the likelihood of unsatisfactory separation of the surplus because the shreds which are to be severed by the cutter or removed by a brush or paddle wheel are properly held in the course of the severing action.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for removing the surplus of tobacco or like fibrous material from one side of a continuous stream, comprising conveyor means for moving the stream lengthwise so that one side of the stream remains exposed; compressing means for compacting spaced-apart portions of the moving stream; filler segregating means including at least one rotary disc having a marginal portion extending into the moving stream, said marginal portion including at least one pocket having an open side facing the exposed side of the stream, the surplus of fibrous material extending beyond said marginal portion; means for rotating said disc at a peripheral speed which at least closely approximates the speed of lengthwise movement of the stream, said pocket being arranged to receive and temporarily confine parts of said compacted portions of the stream; and means for separating the material which extends beyond said marginal portion and is not confined in said pocket so that the thus treated stream is converted into a filler having portions which correspond to said spaced-apart portions of the stream and each of which contains a larger quantity of fibrous material than the remaining portions of the filler as a result of the compacting action of said compressing means and temporary confinement of said spaced-apart portions in said pocket.

2. The apparatus of claim 1, wherein said compressing means includes a device which applies pressure against said one side of the moving stream in a direction toward said conveyor means.

3. The apparatus of claim 1, wherein said conveyor means includes an endless belt and means for attracting the stream against said belt by suction.

4. The apparatus of claim 1, wherein said filler segregating means includes two rotary discs, said rotating means including means for rotating said discs in opposite directions.

5. The apparatus of claim 4, wherein said conveyor means has a longitudinal symmetry plane and successive increments of the marginal portions of said discs approach each other in the region of said plane when said rotating means drives said discs.

6. The apparatus of claim 5, wherein said successive increments contact each other in said symmetry plane.

7. The apparatus of claim 1, wherein said conveyor means comprises an endless band having an elongated material-supporting reach disposed in a first plane and said separating means includes a rotary member disposed in a second plane substantially normal to said first plane.

8. The apparatus of claim 7, wherein said rotary member has peripheral cutting means for fibrous material.

9. The apparatus of claim 7, wherein said rotary member constitutes or resembles a milling cutter.

10. The apparatus of claim 7, wherein said rotary member has peripheral cutting edges making a predetermined angle with the axis of rotation of said rotary member, said reach being arranged to advance the stream in a predetermined direction making with said axis an angle which at least approximates said predetermined angle.

11. The apparatus of claim 10, wherein said angle is an acute angle.

12. The apparatus of claim 1, wherein said compressing means comprises a rotary cam.

13. The apparatus of claim 12, wherein said cam has a plurality of lobes.

14. The apparatus of claim 1, further comprising means for equalizing said one surface of the stream ahead of said compressing means, as considered in the direction of lengthwise movement of the stream.

15. The apparatus of claim 14, wherein said equalizing means comprises a paddle wheel.

16. The apparatus of claim 1, wherein said conveyor means includes an endless conveyor belt having a lower reach with an underside which supports said stream, said lower reach being disposed in a first plane and said disc being disposed in a second plane spaced apart from and substantially parallel to said first plane

17. The apparatus of claim 1, wherein said separating means includes a rotary brush.

* * * * *

UNITED STATES PATENT AND TRADEMARK OFFICE

CERTIFICATE OF CORRECTION

PATENT NO. : 4,485,826

DATED : December 4, 1984

INVENTOR(S) : Uwe HOLZNAGEL

It is certified that error appears in the above-identified patent and that said Letters Patent are hereby corrected as shown below:

Foremost page [75] Inventor: "Holzangel" should read --Holznagel--.

Foremost page add:
--[30] FOREIGN APPLICATION PRIORITY DATA
March 7, 1980, Federal Republic Germany, P 30 08 736.6--.

Column 6, line 27, "an" should read --can--.
Column 7, line 55, "protuberance" should read --protuberances--.
Column 9, line 3, "Q1c" should read --11c--.
Column 10, line 47, 55 and 61, "115 with reference" should read --115a--.
Column 11, line 28, "115a" should read --115 with reference--.

Signed and Sealed this

Seventeenth Day of September 1985

[SEAL]

*Attest:*

*Attesting Officer*

DONALD J. QUIGG

*Commissioner of Patents and Trademarks—Designate*